US011668185B2

(12) United States Patent
Zhan et al.

(10) Patent No.: US 11,668,185 B2
(45) Date of Patent: Jun. 6, 2023

(54) IN-CUTTER SENSOR LWD TOOL AND METHOD

(71) Applicant: SAUDI ARABIAN OIL COMPANY, Dhahran (SA)

(72) Inventors: Guodong Zhan, Dhahran (SA); Timothy Eric Moellendick, Dhahran (SA); Chinthaka P. Gooneratne, Dhahran (SA); Jianhui Xu, Dhahran (SA); Arturo Magana Mora, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 70 days.

(21) Appl. No.: 17/180,083

(22) Filed: Feb. 19, 2021

(65) Prior Publication Data

US 2022/0268146 A1 Aug. 25, 2022

(51) Int. Cl.

| | |
|---|---|
| ***E21B 47/017*** | (2012.01) |
| ***E21B 47/13*** | (2012.01) |
| ***E21B 10/573*** | (2006.01) |
| ***E21B 12/02*** | (2006.01) |
| ***E21B 47/0228*** | (2012.01) |
| ***E21B 47/06*** | (2012.01) |

(52) U.S. Cl.

CPC ..... *E21B 47/017* (2020.05); *E21B 10/5735* (2013.01); *E21B 12/02* (2013.01); *E21B 47/0228* (2020.05); *E21B 47/06* (2013.01); *E21B 47/13* (2020.05)

(58) Field of Classification Search

CPC ..... E21B 47/017; E21B 47/013; E21B 47/01; E21B 47/13; E21B 10/5735; E21B 12/02

See application file for complete search history.

(56) References Cited

U.S. PATENT DOCUMENTS

| | | | |
|---|---|---|---|
| 5,813,480 A | 9/1998 | Zaleski, Jr. et al. | |
| 8,006,781 B2 | 8/2011 | Teodorescu et al. | |
| 8,087,477 B2 | 1/2012 | Sullivan et al. | |
| 8,695,729 B2 * | 4/2014 | Kumar | E21B 47/00 175/50 |
| 8,746,367 B2 | 6/2014 | DiGiovanni et al. | |
| 8,967,295 B2 | 3/2015 | Habernal et al. | |

(Continued)

FOREIGN PATENT DOCUMENTS

| | | |
|---|---|---|
| CN | 111594134 A | 8/2020 |
| WO | 2020205460 A1 | 10/2020 |
| WO | 2020212742 A1 | 10/2020 |

OTHER PUBLICATIONS

International Search Report and Written Opinion of the International Searching Authority issued in corresponding International Application No. PCT/US2022/017035, dated May 4, 2022 (15 pages).

(Continued)

*Primary Examiner* — Shane Bomar

(74) *Attorney, Agent, or Firm* — Osha Bergman Watanabe & Burton LLP

(57) ABSTRACT

An instrumented cutter including a polycrystalline diamond table bonded to a substrate with a sensor, for monitoring the condition of the polycrystalline compact diamond table, embedded in the substrate. Further the instrumented cutter includes a wireless transmitter equipped with a power supply to power to the wireless transmitter.

10 Claims, 5 Drawing Sheets

(56) References Cited

U.S. PATENT DOCUMENTS

| | | | | |
|---|---|---|---|---|
| 9,297,251 | B2 | 3/2016 | Poitzsch | |
| 9,606,008 | B2 | 3/2017 | Liversage | |
| 9,624,729 | B2 | 4/2017 | Sullivan et al. | |
| 9,695,642 | B2 * | 7/2017 | Hay | E21B 47/0228 |
| 9,995,088 | B2 | 6/2018 | DiFoggio | |
| 10,047,566 | B2 | 8/2018 | Vaughn et al. | |
| 10,233,698 | B2 | 3/2019 | Humphrey et al. | |
| 10,443,314 | B2 | 10/2019 | Scott et al. | |
| 10,458,190 | B2 | 10/2019 | Zhang | |
| 10,605,004 | B1 | 3/2020 | Brunner et al. | |
| 10,662,769 | B2 | 5/2020 | Kumar et al. | |
| 10,794,171 | B2 | 10/2020 | Rivera-Rios et al. | |
| 11,111,732 | B2 * | 9/2021 | Zhan | E21B 47/01 |
| 11,486,202 | B2 * | 11/2022 | Xu | G01K 13/00 |
| 2009/0234584 | A1 * | 9/2009 | Casey | E21B 43/26 702/12 |
| 2012/0132468 | A1 | 5/2012 | Scott et al. | |
| 2012/0312599 | A1 | 12/2012 | Trinh et al. | |
| 2013/0068525 | A1 * | 3/2013 | DiGiovanni | E21B 10/567 29/592.1 |
| 2016/0076355 | A1 * | 3/2016 | Scott | E21B 10/55 175/40 |
| 2016/0108725 | A1 * | 4/2016 | Benson | E21B 7/24 367/82 |
| 2016/0194951 | A1 * | 7/2016 | Hay | E21B 44/005 175/45 |
| 2019/0358709 | A1 | 11/2019 | Chen | |
| 2020/0011171 | A1 | 1/2020 | Cao et al. | |
| 2020/0386096 | A1 | 12/2020 | Sugiura et al. | |
| 2021/0032936 | A1 * | 2/2021 | Zhan | E21B 44/00 |
| 2021/0341455 | A1 * | 11/2021 | Smith | G01N 1/286 |
| 2022/0178246 | A1 * | 6/2022 | Hird | E21B 10/42 |
| 2022/0276143 | A1 * | 9/2022 | Magana Mora | G06F 30/27 |

OTHER PUBLICATIONS

Homstvedt, G. et al., "PDC-Bit Evaluation by Cutter Instrumentation and Computer Simulation", SPE 19570, Society of Petroleum Engineers, Oct. 1989, pp. 509-520 (12 pages).

* cited by examiner

IN-CUTTER SENSOR LWD TOOL AND METHOD

BACKGROUND

Drilling a borehole to penetrate a hydrocarbon reservoir is a critical procedure in discovering, evaluating and producing oil and gas. It is common practice to extend the length a borehole by causing a drill bit to rotate while in contact with the rock at the bottom of the borehole. The drill bit typically consists of a plurality of cutters embedded in a plurality of blades arranged over the surface of the drill bit. During drilling the cutters become worn and their efficiency in extending the length of the borehole becomes diminished. Replacing the drill bit is time consuming and expensive and consequently it is undesirable to replace the drill bit sooner or more frequently than essential.

Thus, it is advantageous to have means of monitoring the wear of the cutters and the ability to correlate the wear and rate of wear of the cutters with other drilling parameters. This knowledge may be used to modify the drilling parameters during drilling and to modify the design and construction of future drill bits.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In general, in one aspect, embodiments relate to an instrumented cutter including a polycrystalline diamond table bonded to a substrate with a sensor, for monitoring the condition of the polycrystalline compact diamond table, embedded in the substrate. Further the instrumented cutter includes a wireless transmitter equipped with a power supply to power to the wireless transmitter.

In general, in one aspect, embodiments relate to a system including a string of drill-pipe, suspended from a drilling rig and attached to a bottomhole assembly and a drill bit, for boring a borehole in a rock formation. At least one instrumented cutter containing a sensor is mounted in a blade of the drill bit.

In general, in one aspect, embodiments relate to a method including inserting at least one instrumented cutter into a blade of a drill bit and attaching the drill bit to a bottomhole assembly. Further, the method includes inserting the drill bit and bottomhole assembly attached by a drill string to a drilling rig, into a borehole. The method still further includes increasing the size of the borehole by rotating the drill bit, transmitting a datum from the at least one instrumented cutter to the drilling rig; and modifying at least one parameter of drilling based, at least in part, on the datum from the at least one instrumented cutter. Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
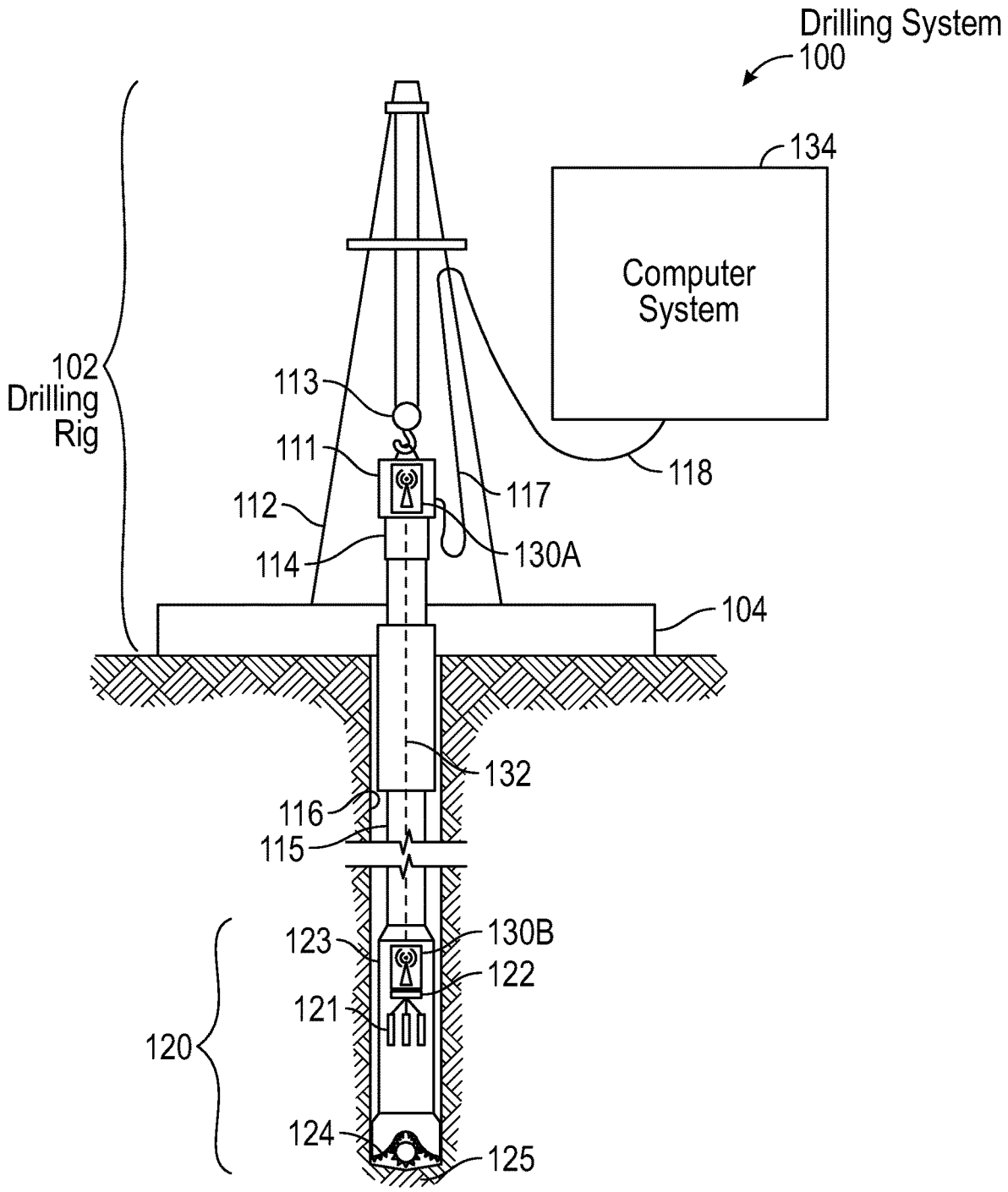
FIG. 1 shows system, in according with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Embodiments disclosed herein relate to an instrumented polycrystalline diamond compact (PDC) cutter mounted in at least one blade of a drill bit. An instrumented PDC cutter is a PDC cutter in which at least one sensor has been embedded. In addition, a source of power, a non-transitory computer memory module, a wireless transceiver and an electronic control module may be embedded in the instrumented PDF cutter to store and transmit the measurements made by sensor. The sensor may make measurements to monitor the state of wear of the cutting surface of the instrumented PDC cutter and these measurements may be store for later retrieval or transmitted to the drilling rig. Modifications to the drilling parameters, including weight on bit, torque, and the time to replace the bit may be made in real-time, or near real-time based at least in part on the measurements. Further, modifications to parameters describing the drill bit design may be made.

In addition, embodiments disclosed herein are directed to a new sensing logging method for monitoring the real-time condition of the PDC cutters in the drill bit by forming an intelligent logging system inside PDC cutter substrates through measuring electrical, capacitive, acoustic, magnetic or other field properties. Data from the sensors may be transferred to the data processing system for drilling optimization and drilling automation. The on-cutter sensing technology of the instrumented PDC cutter has the ability to measure individual PDC cutter wear conditions that permit more accurate correlation of PDC cutter damage reduction to specific bit features and improving iterative improvements. Embodiments disclosed herein also aid in predicting bit performance based on the measurements that may be used to tailor drilling automation algorithms to optimize drilling performance based on current cutter/bit condition.

FIG. 1 illustrates a drilling system (100) which may include a top drive drill rig (110) arranged around the setup of a drill bit logging tool (120). A top drive drill rig (110) may include a top drive (111) that may be suspended in a derrick (112) by a travelling block (113). In the center of the top drive (111), a drive shaft (114) may be coupled to a top pipe of a drillstring (115), for example, by threads. The top drive (111) may rotate the drive shaft (114), so that the drillstring (115), a drill bit logging tool (120), and a drill bit (124) cut the rock formation (125) at the bottom of a borehole (116). A power cable (117) supplying electric power to the top drive (111) may be protected inside one or more service loops (118) coupled to a control system (134). As such, drilling mud may be pumped into the borehole (116) through a mud line, the drive shaft (114), and/or the drillstring (115).

Moreover, when completing a well, casing may be inserted into the borehole (116). The sides of the borehole (116) may require support, and thus the casing may be used for supporting the sides of the borehole (116). As such, a space between the casing and the untreated sides of the borehole (116) may be cemented to hold the casing in place. The cement may be forced through a lower end of the casing and into an annulus between the casing and a wall of the borehole (116).

As further shown in FIG. 1, sensors (121) may be included in a bottomhole assembly "BHA" (123), which is positioned adjacent to a drill bit (124) and coupled to the drill string (115). Sensors (121) may also be coupled to a processor assembly (122) that includes a processor, memory, and an analog-to-digital converter for processing sensor measurements. For example, the sensors (121) may include acoustic sensors, such as accelerometers, measurement microphones, contact microphones, and hydrophones. Likewise, the sensors (121) may include other types of sensors, such as transmitters and receivers to measure resistivity, gamma ray detectors, etc. The sensors (121) may include hardware and/or software for generating different types of well logs (such as acoustic logs or density logs) that may provide well data about a borehole (116), including porosity of borehole sections, gas saturation, bed boundaries in a geologic formation, fractures in the borehole or completion cement, and many other pieces of information about a formation. If such well data is acquired during drilling operations (i.e., logging-while-drilling), then the information may be used to make adjustments to drilling operations in real-time. Such adjustments may include altering weight on bit (WOB), drilling direction, mud weight, torque on bit, and many others drilling parameters.

In accordance with one or more embodiments, a telemetry transceiver (130B) may be installed in the BHA (123) of a drilling system (100) to transmit data and signals through a telemetry channel (132) from the BHA (123) to a telemetry transceiver (130A) located on the drilling rig (102). The telemetry channel (132) may use acoustic signals transmitted through the drilling fluid. In other embodiments, the telemetry channel (132) may use electromagnetic signals transmitted through wired drill pipe. In other embodiments, the telemetry channel (132) may use electromagnetic signals transmitted through the geologic formations to the transceiver (130A) at the Earth's surface (104). The data and signals transmitted through the telemetry channel (132) may be processed and analyzed to determine by a computer system (134). The computer system (134) may be located on the drilling rig (102) or at a remote location.

The computer system (134) may be coupled to the drilling rig (102) in order to perform various functions for extending the length of the borehole (116), such as changing the rotational speed of the drill bit (124) and changing the force applied to the drill bit (124).

Figure 2:
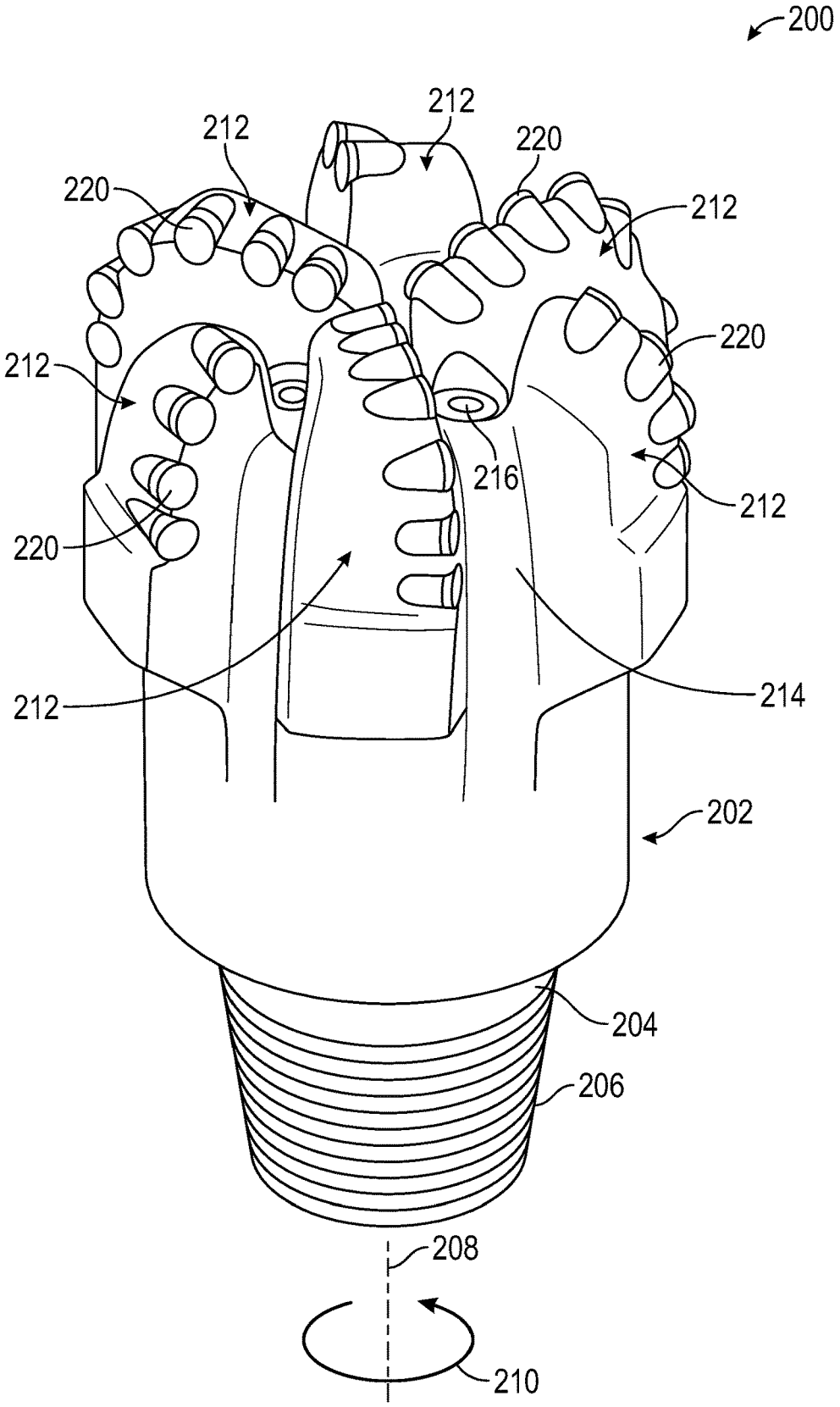
FIG. 2 shows a polycrystalline diamond compact drill bit, in accordance with one or more embodiments.

FIG. 2 shows the features of an example fixed cutter drill bit (200) fitted with PDC cutters for drilling through formations of rock formation (125) to form a borehole, in accordance with one or more embodiments. The drill bit (200) has a bit body (202) rigidly connected to a central shank (204) terminating in a threaded connection (206) for connecting the drill bit to a BHA (123) and to a drill string (115) to rotate the drill bit (200) in order to drill the borehole (116). The drill bit (200) has a central axis (208) about which the drill bit (200) rotates in the cutting direction represented by arrow (210).

In accordance with one or more embodiments, the cutting structure which is provided on the drill bit (200) includes six angularly spaced apart blades (212). In some embodiments, these blades (212) may be identical to each other, and in other embodiments these blades (212) may include a plurality of different blade types or designs. These blades (212) each project from the bit body (202) and extend radially out from the axis (210). The blades (212) are separated by channels that are sometimes referred to as junk slot (214) or flow courses. The junk slots (214) allow for the flow of drilling fluid supplied down the drill string (115) and delivered through apertures (216), which may be referred to as nozzles or ports. Flow of drilling fluid cools the PDC cutters and as the flow moves uphole, carries away the drilling cuttings from the face of the drill bit (200). Those skilled in the art will appreciate that while FIG. 2 shows six (6) blades, any suitable number of blades may be used in the cutting structure of embodiments disclosed herein.

In accordance with one or more embodiments, the blades (212) have pockets or other types of cavities which extend inwardly from open ends that face in the direction of rotation (210). PDC cutters (220) are secured by brazing in these cavities formed in the blades (212) so as to rotationally lead the blades and project from the blades, which exposes the diamond cutting faces of the PDC cutters as shown. According to one or more embodiments, the number of cutters (220) on each blade (212) may be identical; alternatively, the number of cutters (220) may be different on some blades (212) from other blades (212). Similarly, according to one or more embodiments, the position of cutters (220) on each blade (212) may be identical or may be different on some blades (212) from other blades (212).

Continuing with FIG. 2, the drill bit (200) is designed, in accordance with one or more embodiments, to increase the length of the borehole (116) by breaking the rock formation (125) below or in front of the drill bit (200). In accordance with other embodiments, the drill bit (200) may be designed to increase the diameter of a pre-existing borehole (116) by breaking the rock formation which forms the walls of the pre-existing borehole (116). This process of increasing the diameter of a pre-existing borehole (116) may be called reaming, and the drill bit (200) used for reaming may be called a reamer. Reaming may be used to enlarge a section of a hole if the hole was not drilled as large as it should have been at the outset. This can occur when a drill bit (200) has been worn down from its original size but has been undetected until the drill bit (200) and drill string (115) is removed from the borehole (116). In other cases, some rock formations (125) may slowly plastically deform into the wellbore over time, thus requiring the reaming operation to maintain the original hole size. Reamer drill bit may also have PDC cutters (220) mounted in their blades (212).

Figure 3:
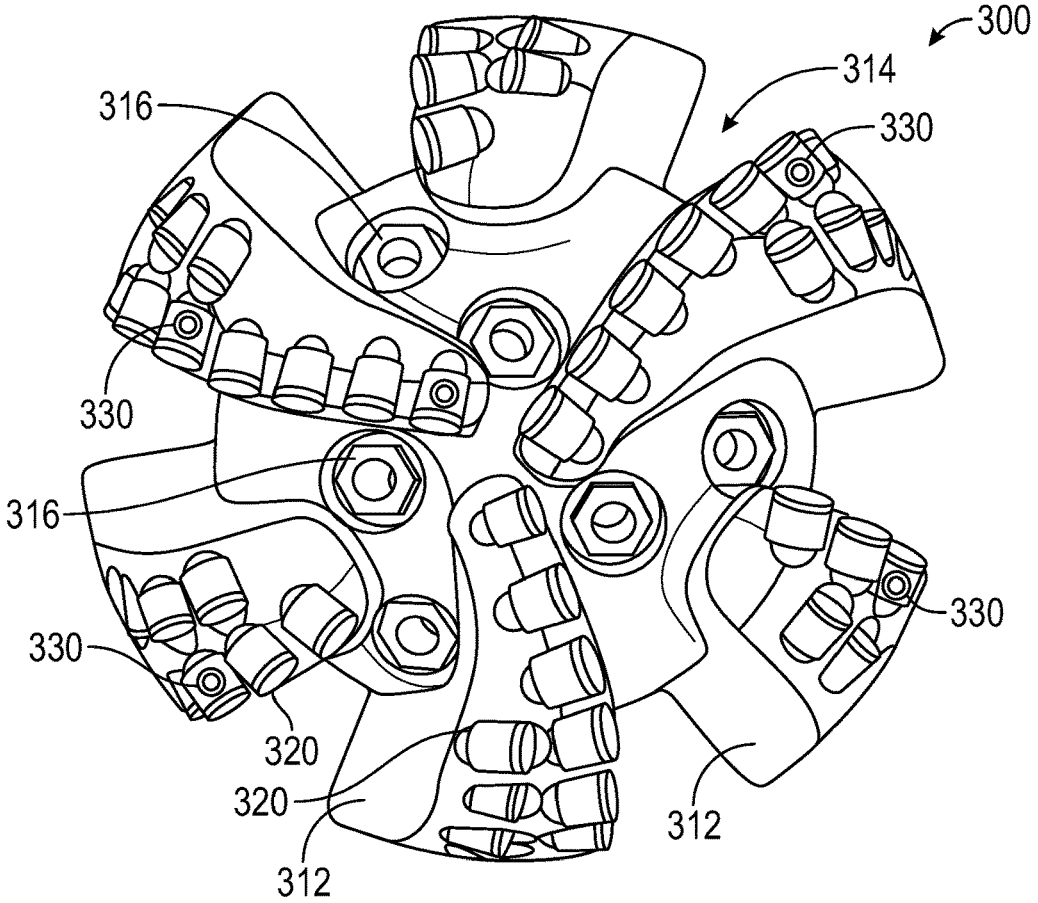
FIG. 3 shows a polycrystalline diamond compact drill bit, in accordance with one or more embodiments.

FIG. 3 shows the face of a drill bit (300), in accordance with one or more embodiments. FIG. 3 shows six nozzles (316) penetrating the body of the drill bit (300) to permit the exodus of drilling mud from the interior of the drill string (115) and the interior of the drill bit (300). FIG. 3 further shows six blades (312) of two different design, each separated by a junk slot (314). On each blade (312) a plurality of cutters (320 and 330) are mounted. As noted above, those of ordinary skill in the art will appreciate that any number of nozzles and blades may be employed by embodiments disclosed herein, without departing from the scope of this disclosure.

In accordance with one or more embodiments, at least one of the PDC cutters is an instrumented PDC cutter (330). An instrumented PDC cutter (330) differs from a non-instrumented PDC cutter (320) in that an instrumented PDC cutter (330) may contain at least one sensor to monitor the state of wear of the instrumented PDC cutters (330). In accordance with some embodiments, the instrumented PDC cutters (330) may be located at key locations anticipated by the operators to be locations at which the PDC cutters (330) may experience a maximum rate of wear. In accordance with one or more embodiments, the instrumented PDC cutters (330) may be positioned at the same position on each blade (312). In accordance with other embodiments, the instrumented PDC cutters (330) may be positioned at different locations on each blade (312). In accordance with still other embodiments, all the PDC cutters (320) in drill bit (300) may be instrumented PDC cutters (330).

Figure 4:
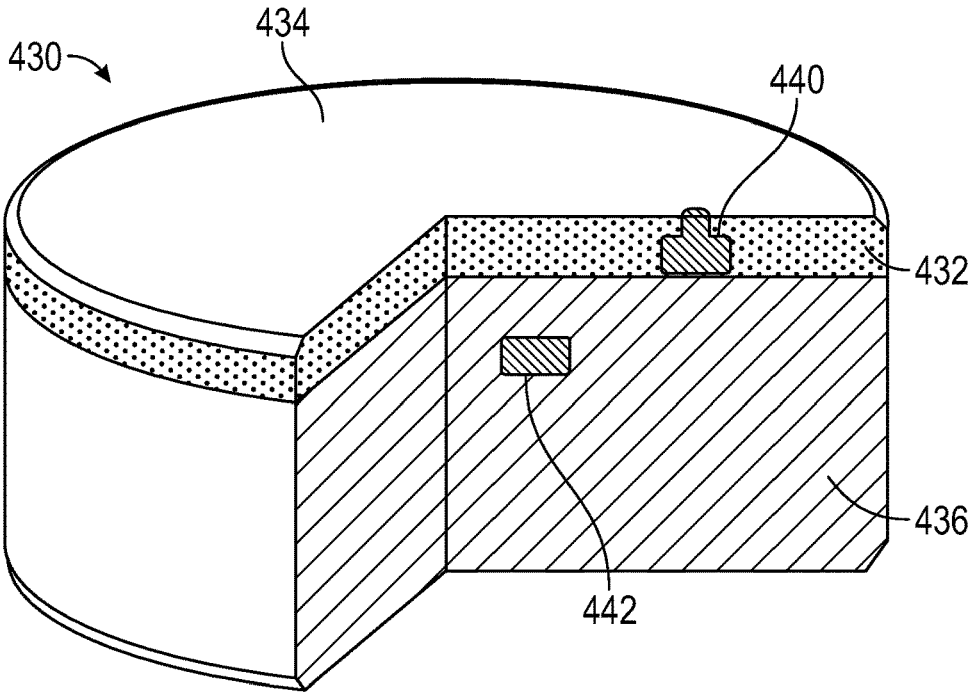
FIG. 4 shows a cutter, in accordance with one or more embodiments.

FIG. 4 depicts an instrumented PDC cutter (430) in accordance with one or more embodiment. Both instrumented PDC cutters (430) and non-instrumented PDC cutters (320) may be formed from two components. The first component, of a PDC cutter (430) is known as the PDC diamond table (432) is formed from polycrystalline diamond. PDC is an aggregate of tiny, inexpensive, manmade diamonds into relatively large, intergrown masses of randomly oriented crystals that can be formed into useful shapes. The PDC diamond table (432) forms the cutting surface (434) of the instrumented PDC cutters (430) that contacts the rock formation (125). Diamond, one of the hardest known materials, gives the cutting surface (434) of the PDC diamond tables (432) superior cutting properties. Besides their hardness, PDC diamond tables (432) have an essential characteristic for drill bit cutters. PDC diamonds efficiently bond with tungsten carbide. Tungsten carbide may be used to form a substrate (436) that can be attached to the blades (312) of a drill bit (300). The attaching of the substrate (436) to the blades (312) may be performed by brazing, a joining by soldering with an alloy of silver, copper and zinc at high temperature, wherein the high temperature may be above 840° F.

FIG. 4 further shows, in accordance with one or more embodiments, a first sensor (440) and a second sensor (442). The presence of at least one of these sensors (440, 442) distinguish an instrumented cutter (430) from a non-instrumented cutter (320). In accordance with one or more embodiment, the first sensor (440) may be embedded in the PDC diamond table (432) and may extend to the cutting surface (434), and may be configured to directly sense or remotely monitor wear of the cutting surface (434). In accordance with other embodiments, the first sensor (440) may be embedded in the PDC diamond table (432) and may not extend to the cutting surface (434), but instead may be wholly enclosed within the PDC diamond table (432), and configured to remotely sense or remotely monitor wear of the cutting surface (434).

A second sensor (442) may be embedded in the substrate (436) of the instrumented PDC cutter (430). The second sensor (442) may be configured to remotely sense or remotely monitor wear of the cutting surface (434). Although FIG. 4 shows a first sensor (440) embedded in the PDC diamond table and a second sensor (442) embedded in the substrate (436) of the instrumented PDC cutter (430) it should be understood that these are only illustrations of one of many configurations. In particular, in accordance with one or more embodiment, an instrumented PDC cutter may have only one sensor, that may be either embedded in the PDC diamond table (432) or in the substrate (436) of the instrumented PDC cutter (430). Alternatively, in accordance with other embodiments, the instrumented PDC cutter (430) may have any combination of at least one first sensor (440) embedded in the PDC diamond table (432) and at least one second sensor (442) embedded in the substrate (436) of the instrumented PDC cutter (430). Furthermore, in accordance with other embodiments each of a plurality of first sensors (440) embedded in the PDC diamond table (432) may not be identical to others of plurality of first sensors (440).

In particular, each of the plurality of first sensors (440) may use a different sensing modality. For example, one member of a plurality of first sensors (440) may be sensitive to electrical capacitance, and a second member of a plurality of second sensors (440) may be sensitive to ultrasonic propagation time. Similarly, each of the plurality of second sensors (442) may use a different sensing modality. For example, one member of a plurality of second sensors (442) may be sensitive to electrical capacitance, and a second member of a plurality of second sensors (442) may be sensitive to ultrasonic propagation time. Further a first sensor (440) embedded in the PDC diamond table (432) may use a sensing modality different from a second sensor (442) embedded in the substrate (436) of the instrumented PDC cutter (430).

Figure 5:
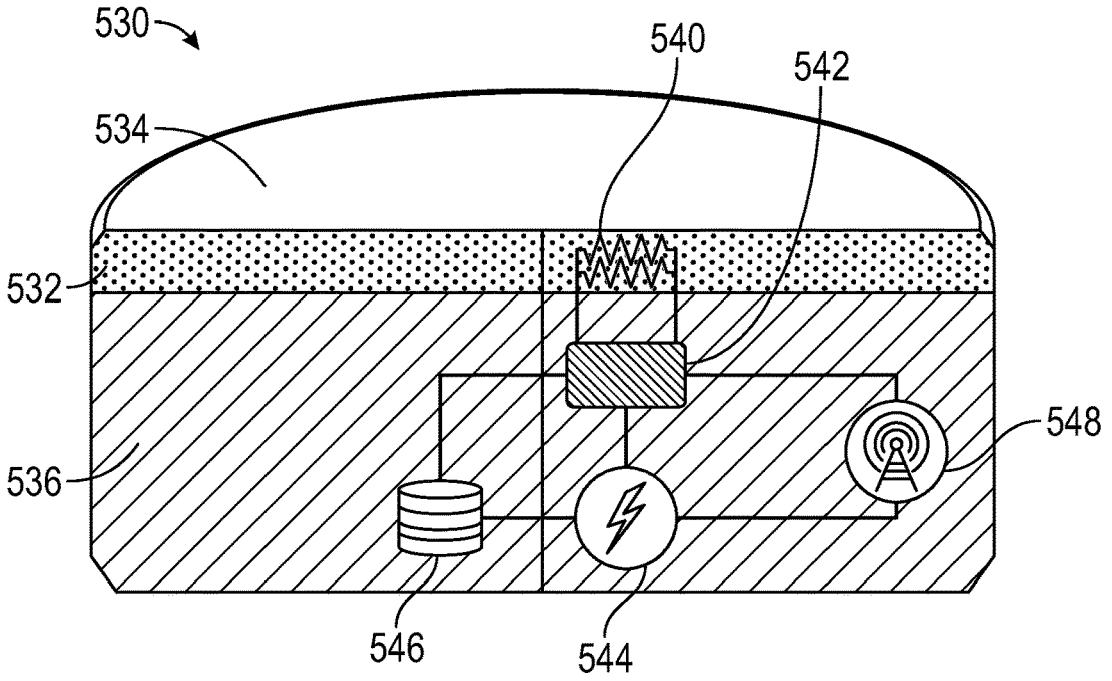
FIG. 5 shows an instrumented cutter, in accordance with one or more embodiments.

In accordance with one or more embodiments, FIG. 5 depicts an instrumented PDC cutter (510) configured to monitor the wear of the cutting surface (534) of the PDC diamond table (532) using the resistivity of a sensor (540) embedded in the PDC diamond table (532). FIG. 5 further depicts, in accordance with one or more embodiments, an electronics module (542) embedded in the substrate (536) of the instrumented PDC cutter (530) configured to monitor the resistivity of the resistivity sensor (540) and to store the resistivity values recorded by the resistivity sensor in a non-transient computer memory module (546) embedded in the substrate (536) of the instrumented PDC cutter (530).

In accordance with one or more embodiments, FIG. 5 further depicts a wireless transceiver (548) that may be embedded in the substrate (536) of the instrumented PDC cutter (530) and configured to transmit the resistivity values recorded by the resistivity sensor to a wireless telemetry transceiver mounted in the drill bit body (202), or the BHA (123). The wireless transceiver (548) may be a Wi-Fi transceiver, a Bluetooth transceiver, an induction wireless transceiver, an infrared wireless transceiver, an ultra-wideband transceiver, a ZigBee transceiver, or an ultrasonic transceiver.

FIG. 5 further depicts, in accordance with one or more embodiments, a power supply (544) to provide power to at least one of the non-transient computer memory module (546), the electronics module (542), the wireless transceiver (548), and the first sensor (540). The power supply (544)

may be a battery, or an energy harvesting device that converts vibration to electrical power, or a terminal electrically connect to a power supply (not illustrated) located in the drill bit (200), or located in the BHA (123).

Although FIG. 5 shows a single first sensor (540), in accordance with one or more embodiments, this is intended to in no way limit the scope of the invention. It will be obvious to one of ordinary skill in the art that the instrumented PDC cutter may, in other embodiments have a plurality of sensors, that may share one or more of a single power supply (544), a non-transient computer memory module (546), an electronics module (542) and a wireless transceiver (548). Alternatively, each of a plurality of sensors may each be configured with their individual power supply (544), a non-transient computer memory module (546), an electronics module (542) and a wireless transceiver (548).

Figure 6:
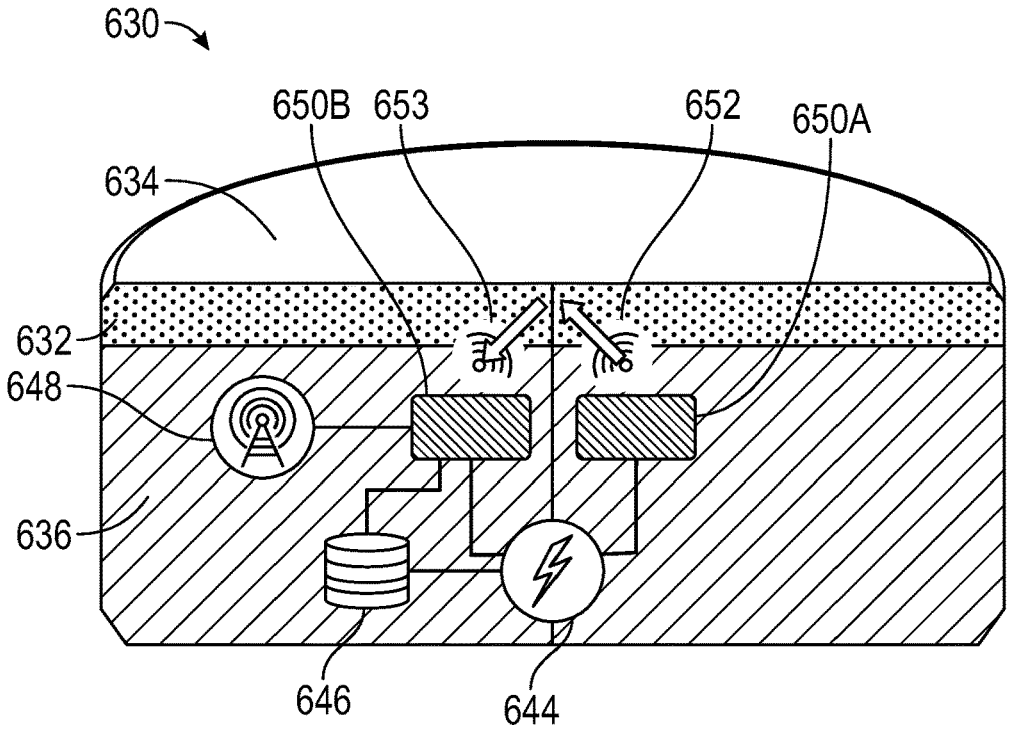
FIG. 6 shows an instrumented cutter, in accordance with one or more embodiments.

FIG. 6 depicts, in accordance with one or more embodiments, an example of remote sensing sensors (650A, 650B) embedded in an instrumented PDC cutter (630). According to one or more embodiments, the remote sensing sensor (650A) may be an ultrasonic transceiver that emits an ultrasonic wave (652). The ultrasonic wave (652) may be reflected by the cutting surface (634) of the PDC diamond table (632) and the reflected ultrasonic wave (653) may be detected by an ultrasonic transceiver (653). In accordance with one or more embodiment, the wear of the cutting surface (634) or the instrumented PDC cutter (630) may be determined from the travel time of the reflected ultrasonic wave (652). In accordance with other embodiments, the wear of the cutting surface (634) of the instrumented PDC cutter (630) may be determined from the amplitude of the reflected ultrasonic wave (653). In accordance with further embodiments, the wear of the cutting surface (634) of the instrumented PDC cutter (630) may be determined from the spectrum of the reflected ultrasonic wave (653). In accordance with still further embodiments, the wear of the cutting surface (634) of the instrumented PDC cutter (630) may be determined from a combination of at least one of the travel time, the amplitude, and the spectrum of the reflected ultrasonic wave (653). In accordance with one or more embodiments, the ultrasonic transceiver (650A) emitting the ultrasonic wave (652) and the ultrasonic transceiver (650B) receiving the reflected ultrasonic wave (653) may be one single transceiver performing both the emission and the reception of ultrasonic waves.

Just as the resistivity sensor (540) shown in FIG. 5 may be equipped with a power supply (544), a non-transient computer memory module (546), an electronics module (542) and a wireless transceiver (548) similarly the ultrasonic sensor (650A, 650B) shown in FIG. 6 may, in accordance with one or more embodiments, be equipped with a power supply (644), a non-transient computer memory module (646), and a wireless transceiver (648). One or more of the ultrasonic sensors (650A, 650B), power supply (644), non-transient computer memory module (646), and wireless transceiver (648) may be embedded in the cutter substrate (636).

Figure 7:
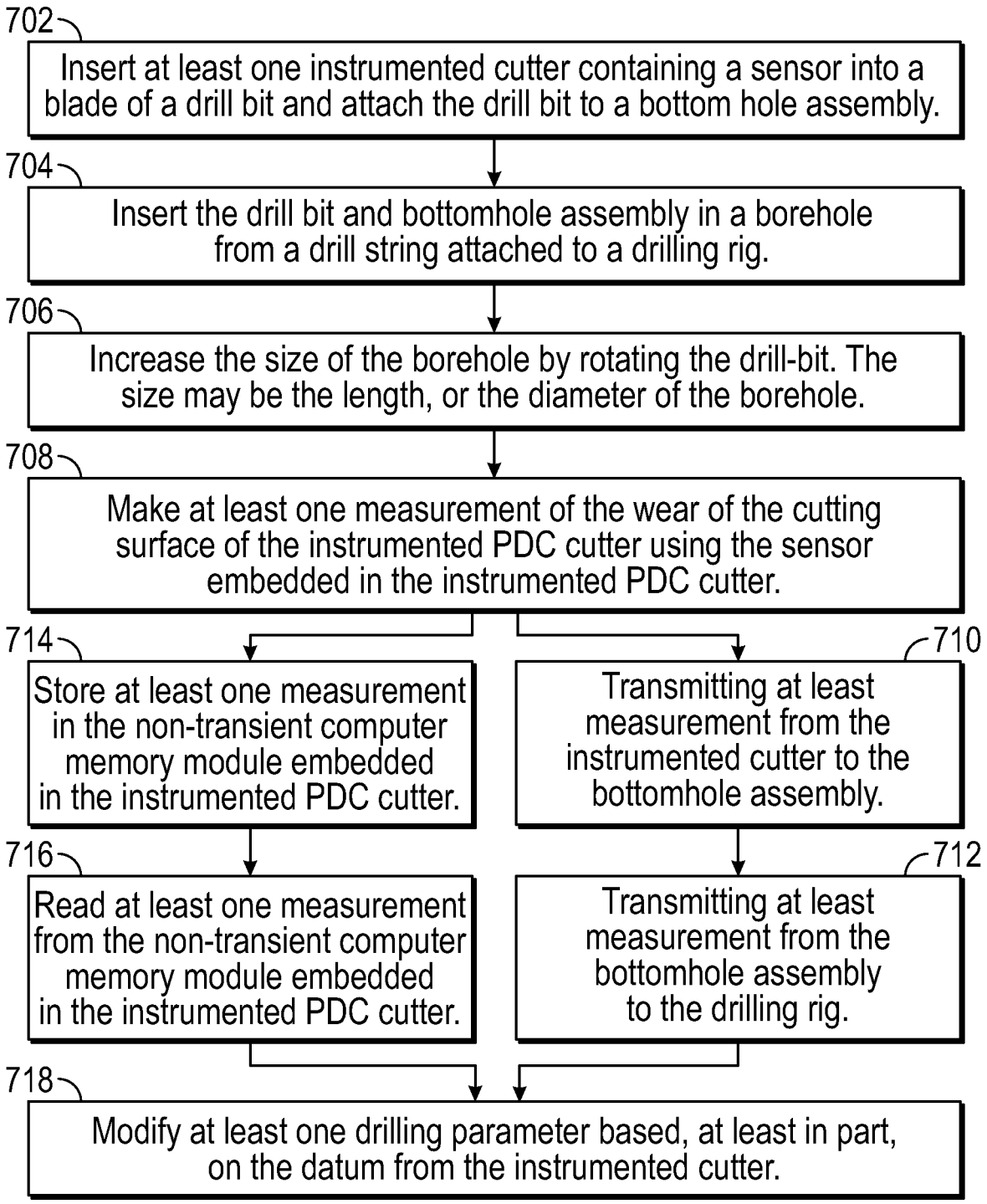
FIG. 7 shows a flowchart, in accordance with one or more embodiments.

FIG. 7 depicts a flowchart, in accordance with one or more embodiments. One or more blocks of FIG. 7 may be performed using one or more components as described in FIGS. 1 through 6. While the various blocks in FIG. 7 are presented and described sequentially, one of ordinary skill in the art will appreciate that some or all of the blocks may be executed in a different order, may be combined or omitted, and some or all of the blocks may be executed in parallel and/or iteratively. Furthermore, the blocks may be performed actively or passively.

Initially, in Step 702, at least one instrumented PDC cutter (330) is inserted into at least one blade (312) of a drill bit (300). The instrumented PDC cutter (430) may include at least one sensor (440, 442), that may be configured to monitor the wear of the cutting surface (434) of the instrumented PDC cutter (430). In accordance with other embodiments, each blade (312) may be equipped with a plurality of instrumented cutters (430). The instrumented PDC cutter (430) may be differ in design from one another and may use different physical sensing modalities.

In Step 704 the drill bit (300) and BHA (123) may be inserted into a borehole (116) attached to a drill string (115) extending from the BHA (123) to a drilling rig (102). The drill string (115) may include a plurality of joints of drill pipe, a plurality of joints of wired drill pipe, or a coiled tubing, in accordance with one or more embodiments. The insertion of the drill bit (300), BHA (123), and drill string (115) may comprise suspending the drill bit (300), BHA (123), and drill string (115) from the drilling rig (102).

In Step 706, in accordance with one or more embodiments, the size of the borehole (116) may be increased by rotation of the drill bit (300). The rotation of the drill bit (300) may be caused by the rotation of the drill string (115) that is, in turn, caused by the rotation of equipment on the drilling rig (102). In accordance with other embodiments, the rotation of the drill bit (300) may be caused by the rotation of a mud-motor, or electrical motor mounted in the BHA (123). The size of the borehole increases, at least in part, by the abrasion of one or more instrumented PDC cutters (430) against the rock formation (125). In accordance with one or more embodiments, the increase in size of the borehole (116) may be an increase in the length of the borehole (116). In accordance with other embodiments, the increase in size of the borehole (116) may be an increase in the diameter of the borehole (116) or may be a simultaneous increase in both the length and the diameter of the borehole (116).

In Step 708, in accordance with one or more embodiments, at least one measurement may be made of the wear of the cutting surface (434) of an instrumented PDC cutter (430) by at least one sensor (440, 442) embedded in the PDC diamond table (432), or the substrate (436) of the instrumented PDC cutter (430). The measurement may be based upon the following without limitation, a strain, an acceleration, a motion, a vibration, an image, an electrical resistance, an electrical capacitance, an electrical inductance, a magnetic field, and a photoelectric emission, alone or in combination with one another.

In accordance with one or more embodiments, in Step 710 at least one measurement may be transmitted from the instrumented PDC cutter (430) to the BHA (123). The transmission of at least one measurement from the instrumented PDC cutter (430) to the BHA (123) may be performed using at least one wireless transceiver selected from the group composed of a Wi-Fi transceiver, a Bluetooth transceiver, an induction wireless transceiver, an infrared wireless transceiver, an ultra-wideband transceiver, a ZigBee transceiver, or an ultrasonic transceiver, and from the BHA to the drilling rig.

In Step 712, in accordance with one or more embodiment, at least one measurement may be transmitted from the BHA (123) to the drilling rig (102). The transmission of at least one measurement may be performed using mud-pulse telemetry, wired drill pipe telemetry, wired coiled tubing telemetry, or electromagnetic induction telemetry.

In accordance with one or more embodiments, in Step 718, at least one drilling parameter may be modified based, at least in part, on at least one measurement from the instrumented PDC cutter (430). The modified drilling parameter(s) may include, without limitation, a weight on bit (WOB), a drilling direction, a mud weight, torque on bit, and many other drilling parameters. The modification of one or more drilling parameters may be performed in real-time. The modification may be commanded by an operator based, at least in part, on inspection of the measurement and/or change in the measurement. The modification may be commanded or performed by a drilling automation algorithm based, at least in part, on the measurement and/or a change in the measurement. The measurement may further allow the operator to determine the grade of the PDC cutter and the bit composed of a plurality of cutters, including how "dull" or worn are the plurality of PDC cutters.

The modification of drilling parameters may include the time at which it is optimal to replace the bit, including the retraction of the drill string (115), the BHA (123), and the drill bit (124) from the borehole (102); the replacements if the drill bit (124) with a new and unworn drill bit (124), and the insertion of the drill string (115), the BHA (123), and the drill bit (124) into the borehole (102).

In accordance with one or more embodiments, in Step 714 at least one measurement may be stored in the non-transient computer memory module (546, 646) embedded in the instrumented PDC cutter (530, 630). In Step 716, in accordance with one or more embodiment, at least one measurement from the non-transient computer memory module (546, 646) embedded in the instrumented PDC cutter (530, 630) may be read. The non-transient computer memory module (546, 646) may be read when the drill bit (300), BHA (123) and drill string (115) is retracted from the borehole (102). In accordance with other embodiments, the modified parameter may be a parameter describing the design of a drilling bit (300), or the design of a PDC cutter (320). In accordance with other embodiments, the modified parameters may be control parameters in drilling automation algorithms which perform the automatic control of drilling parameters, and predict the current and future performance of the drill bit (300).

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, any means-plus-function clauses are intended to cover the structures described herein as performing the recited function(s) and equivalents of those structures. Similarly, any step-plus-function clauses in the claims are intended to cover the acts described here as performing the recited function(s) and equivalents of those acts. It is the express intention of the applicant not to invoke 35 U.S.C. § 112(f) for any limitations of any of the claims herein, except for those in which the claim expressly uses the words "means for" or "step for" together with an associated function.

What is claimed is:

1. An instrumented cutter, comprising:
- a polycrystalline diamond table;
- a substrate bonded to the polycrystalline diamond table;
- a sensor, for monitoring a condition of the polycrystalline diamond table, embedded in the substrate,
  - wherein the sensor comprises an ohmmeter for measuring an electrical resistance of each member of a plurality of electrical conductors embedded in the polycrystalline diamond table;
- a wireless transmitter embedded in the substrate and attached to the sensor; and
- a power supply embedded in the substrate to provide power to the sensor, and power to the wireless transmitter.

2. The instrumented cutter of claim 1, further comprising a non-transient computer memory module to record at least one datum from the sensor and powered by the power supply.

3. The instrumented cutter of claim 1, wherein the sensor further comprises a device to measure a physical property chosen from the group consisting of a strain, an acceleration, a motion, a vibration, an image, an electrical capacitance, an electrical inductance, a magnetic field, and a photoelectric emission.

4. The instrumented cutter of claim 1, wherein the sensor measures a change in the electrical resistance.

5. The instrumented cutter of claim 1, wherein each of the plurality of electrical conductors are embedded at different depths below a cutting surface of the polycrystalline diamond table.

6. The instrumented cutter of claim 1, wherein the sensor further comprises at least one ultrasonic transducer for measuring wear of the polycrystalline diamond table, by exciting the polycrystalline diamond table with an ultrasonic pulse and recording an ultrasonic vibration of the polycrystalline diamond table.

7. The instrumented cutter of claim 1, wherein the wireless transmitter transmits at least a datum from the sensor to a wireless receiver mounted at a location selected from a group consisting of a drill bit, and a bottomhole assembly.

8. The instrumented cutter of claim 7, wherein the wireless transmitter and wireless receiver are devices selected from the group consisting of a Wi-Fi device, a Bluetooth device, an induction wireless device, an infrared wireless device, an ultra-wideband device, a ZigBee device, or an ultrasonic device.

9. The instrumented cutter of claim 1, wherein, the power supply is selected from the group consisting of a battery, an energy harvester device, an inductive coupling, and an electrical conductor.

10. The instrumented cutter of claim 9, wherein the energy harvester device is selected from the group consisting of: a piezoelectric device, an electrostatic device, an electromagnetic device, and an electret device.

* * * * *